US005401332A

United States Patent [19]

Lee et al.

[11] Patent Number: 5,401,332

[45] Date of Patent: Mar. 28, 1995

[54] GRAIN ORIENTED ELECTRICAL STEEL SHEET HAVING SUPERIOR MAGNETIC PROPERTIES, AND MANUFACTURING PROCESS THEREOF

[75] Inventors: Chung S. Lee; Jong S. Wo, both of Pohang City, Rep. of Korea

[73] Assignees: Pohang Iron & Steel Co., Ltd.; Research Institute of Industrial Science & Technology, both of Book-Do, Rep. of Korea

[21] Appl. No.: 988,116

[22] PCT Filed: Aug. 13, 1991

[86] PCT No.: PCT.AU91/00358

§ 371 Date: Feb. 9, 1993

§ 102(e) Date: Feb. 9, 1993

[30] Foreign Application Priority Data

Jul. 12, 1991 [KR] Rep. of Korea ..... 91-11905

[51] Int. Cl.[6] ..... H01F 1/16

[52] U.S. Cl. ..... 148/111; 148/307; 148/308

[58] Field of Search ..... 148/111, 113, 307, 308

[56] References Cited

U.S. PATENT DOCUMENTS 3,855,018 12/1974 Salsgiver et al. ..... 148/112

FOREIGN PATENT DOCUMENTS 52-6329 1/1977 Japan .

*Primary Examiner*—George Wyszomierski

*Attorney, Agent, or Firm*—Webb Ziesenheim Bruening Logsdon Orkin & Hanson

[57] ABSTRACT

A grain oriented electrical steel having superior magnetic properties and for use in transformers and electrical generators, and a manufacturing process thereof are disclosed. Cu and P are mixedly added in the melting stage of a silicon steel containing MnS and AlN as grain growth inhibitors, and in this way, the magnetic properties are improved. The chemical composition of the steel sheet of the present invention are: 2.50–4.00% of Si, 0.03–0.15% of Mn, 0.030–0.300% of Cu, and 0.020–0.200% of P, the balance being Fe, all in weight %. The grain oriented electrical steel sheet of the present invention shows a low iron loss and a high magnetic flux density, and is cold-rolled to a thickness range of 0.15–0.27 mm.

4 Claims, 1 Drawing Sheet

GRAIN ORIENTED ELECTRICAL STEEL SHEET HAVING SUPERIOR MAGNETIC PROPERTIES, AND MANUFACTURING PROCESS THEREOF

FIELD OF THE INVENTION

The present invention relates to a grain oriented electrical steel sheet used as steel cores for transformers and electrical generators and a manufacturing process thereof, and particularly to a grain oriented electrical steel sheet and a manufacturing process thereof, in which the steel sheet has superior magnetic properties such as low iron loss and high magnetic flux density, as well as being applicable to thin gauge products.

BACKGROUND OF THE INVENTION

Generally, the grain oriented electrical steel is a soft magnetic material exhibiting superior magnetic properties in its rolling direction, and this material has to be easy to magnetically excite and low in its iron loss. The exciting property is evaluated based on the level of the magnetic flux density $B_{10}$ which is induced by a certain level of magnetizing force (1000 A/m), while the iron loss is evaluated by the magnitude of energy loss ($W_{17/50}$) which occurs when the steel is induced to a certain level of magnetic flux density (1.7 Tesla) by an alternating current of a certain frequency (50 Hz).

A material showing a high magnetic flux density is usually used in miniature high performance electrical apparatuses, while a low iron loss means a low energy dissipation.

In a grain oriented electrical steel sheet which consists of crystal grains having an orientation of (110)[001] in the Miller indices, if the magnetic flux density and the iron loss properties are to be improved, the orientation of the steel has to be improved. That is, the direction [001], which is the direction of easy magnetization, has to correspond with the rolling direction of the steel sheet.

The grain oriented electrical steel in the industrial field is manufactured by utilizing the so-called secondary recrystallization phenomenon which occurs during the final annealing process (which is carried out at a high temperature of over 1000° C.,) after cold-rolling the steel sheet to the final thickness, and after subjecting it to a decarburizing annealing.

During the secondary recrystallization, the grains having the orientation of (110)[001] devour surrounding grains having the other orientation and grow to very large sized grains.

If such a secondary recrystallization is to be producted in a perfect manner, there is required an inhibiting force which inhibits the normal growth of the primary recrystallization grains of the other orientations, during the growth of the secondary recrystallization grains.

Further, recently in pace with the increased need for the saving of energy, it is demanded that the thickness of the steel sheet be reduced in addition to the improvement of orientation in order to improve the iron loss. This is due to the fact that eddy current loss which occupies the greater part of the iron loss is proportionate to a square of the thickness of the steel sheet, and that the thinner the thickness of steel sheet is, the smaller the iron loss is. However, if the thickness of the steel sheet is made thinner, not only the secondary recrystallization becomes unstable, but also the orientation is degraded. Therefore, the lower limit of the thickness of the grain oriented electrical steel sheet which can be manufactured in a stable manner by the normal method is about 0.30 mm.

Therefore, if the iron loss is to be improved by reducing the thickness of the steel sheet, the inhibiting force against the normal growth has to be reinforced, so that the secondary recrystallization should occur in a perfect manner.

As a method of inhibiting grain growth during the manufacturing of the grain oriented electrical steel sheet, it is known that one or more of precipitating compounds such as MnS, AlN, MnSe and the like or grain boundary segregating elements are added at the melting stage, and that a precipitation treatment is carried out on the steel sheet at a later step of the process.

According to Zener's formula, the inhibiting force is defined to be $\sigma\Omega/Yo$ ($Yo$: average particle size of the precipitates, $\Omega$: volume fraction of the precipitations, and $\sigma$: grain boundary energy). According to this formula, if the value of $Yo$ is small, and if $\Omega$ is large, then the inhibiting force is increased. That is, if fine precipitates can be formed, a sufficient inhibiting force can be obtained with only the precipitations, the logical conclusion being so. However, in actuality, there is a limit to simultaneously achieving a large amount of precipitates and a reduction of the their size, and therefore, it should be effective to add and distribute two or more precipitating compounds or grain boundary segregating elements.

In the method for improving the orientation of the grain oriented electrical steel as described above, if a high reduction ratio is used in the final cold rolling process, the driving force for the growth of the primary recrystallization grains is increased, and therefore, a larger inhibiting force is required.

For example, a magnetic flux density of about 1.8 Tesla is obtained by carrying out a cold rolling process using a reduction ratio of 60% in one of the conventional oriented electrical steels. In such a case, MnS precipitates are used as main inhibitors. On the other hand, in another oriented electrical steel in which a magnetic flux density of 1.90 Tesla is obtained by carrying out a cold rolling process using a higher reduction ratio of over 80%, two or more of precipitating compounds such as MnS and AlN are used as the inhibiting agents.

Further, according to Japanese Patent Publication No. Sho57-45818, the grain growth inhibiting force is reinforced by adding Cu as a sulfide forming element in addition to MnS and AlN, and a reduction ratio of 87% is applied, thereby providing a process for manufacturing a grain oriented electrical steel sheet having superior magnetic properties.

Meanwhile a process of adding P in the melting stage of the grain oriented electrical steel is disclosed in Japanese Patent Publication No. Sho-52-6329. By adding P, the precipitates such as MnS and AlN can be more uniformly distributed in the form of tiny particles, and consequently, the secondary recrystallization grains become more fine, thereby improving the iron loss properties. However, if the effect of the addition of P is to be obtained, Ni has to be necessarily added, and, if its addition is less than 0.03%, the secondary recrystallization becomes unstable.

SUMMARY OF THE INVENTION

Therefore it is the object of the present invention to provide a grain oriented electrical steel sheet and a manufacturing process thereof, in which the secondary recrystallization grains can be developed in a stable manner with an acceptable orientation even with a thin thickness, thereby providing a high magnetic flux density and low iron loss oriented electrical steel sheet.

The present inventors have performed repeated experiments in order to find a process for manufacturing a high magnetic flux density and low iron loss oriented thin electrical steel sheet by adding elements contributing to reinforcing the inhibiting force. The present inventors tried the following process. That is, Cu and P were added in the amounts of 0.030–0.300% and 0.020–0.200% respectively in the melting stage of a silicon steel containing MnS and AlN as the basic inhibiting agents, and then, the normal manufacturing process which is usually carried out on the high magnetic flux density oriented electrical steel sheet was performed. For such a case, the present inventors found that, even when the thickness of the cold rolled steel sheet was 0.15–0.27 mm as well for the case of 0.30–0.35 mm, a good oriented secondary recrystallization was developed in a stable manner, thereby making it possible to obtain a low iron loss and high magnetic flux density oriented electrical steel sheet.

An electron micrograph showed that Cu which is added at the melting stage forms precipitates in the form of $Cu_2S$, and P is segregated on the grain boundary. Based on this fact, it can be asserted that, if Cu and P are added into a silicon steel containing MnS and AlN, the grain growth inhibiting force is more reinforced, with the result that the secondary recrystallization is developed in a stable manner, and that its orientation is more improved.

Based on the above described facts, the present invention provides a low iron loss and high magnetic flux density oriented electrical steel sheet and a manufacturing process thereof, in which the grain growth inhibiting force is reinforced by mixedly adding Cu and P at the melting stage, thereby forming a grain oriented electrical steel sheet which can be applied even to thin gauge products.

BRIEF DESCRIPTION OF THE DRAWINGS

The above object and other advantages of the present invention will become more apparent by describing in detail the preferred embodiment of the present invention with reference to the attached drawing in which.

DESCRIPTION OF THE PREFERRED EMBODIMENT

Figure 1:
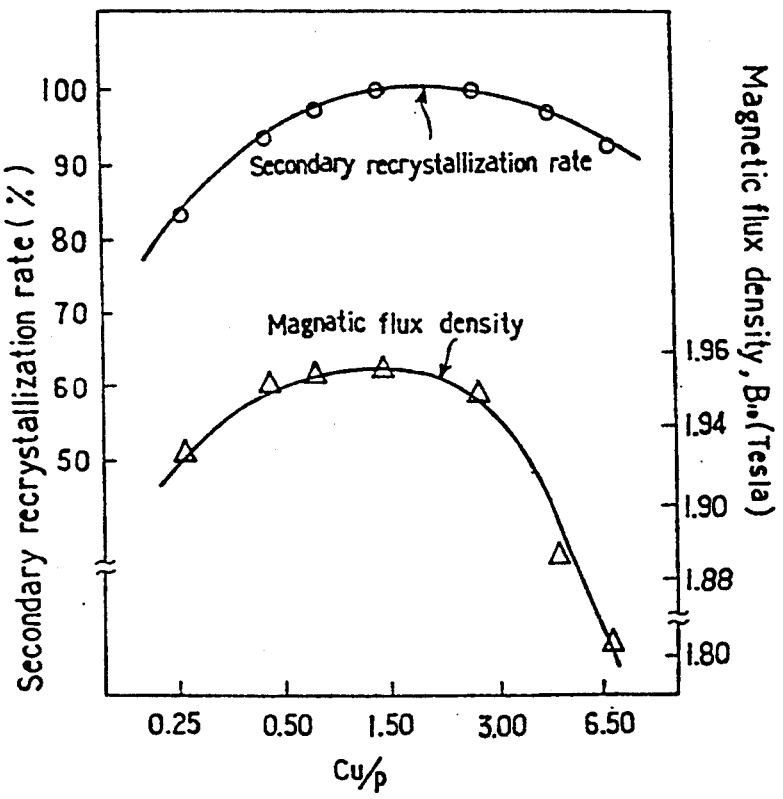
FIG. 1 is a graphical illustration showing the variation of the secondary recrystallization versus the addition ratio of Cu and P (Cu/P).

The present invention provides a grain oriented electrical steel sheet having superior magnetic properties, in which the chemical composition is Si: 2.50–4.00%, Mn: 0.03–0.150%, Cu: 0.030–0.300%, P: 0.020–0.200%, Fe: balance,. all in weight %.

More specifically, the grain oriented electrical steel sheet of the present invention is manufactured in the following manner. That is, Cu and P are added in the amounts of 0.030–0.300% and 0.020–0.200% respectively in the melting stage of a silicon steel which contains: 0.0300–0.100% of C, 2.50–4.00% of Si, 0.030–0.150% of Mn, 0.010–0.050% of S, 0.010–0.050% of soluble Al, and 0.0030–0.0120% of N, the balance being Fe, all in weight %. Then the silicon steel slab undergoes further processing such as hot rolling, precipitation annealing, acid washing, cold rolling, decarburizing annealing, coating of an annealing separator and high temperature annealing, thereby obtaining a grain oriented electrical steel sheet having superior magnetic properties.

Now the reasons for limiting the values of the additions will be described below.

If the added amount of C is less than 0.030 weight % (to be expressed "%" below), the crystallized grains in the slab are coarsely grown, with the result that the development of the secondary recrystallization becomes unstable during the final high temperature annealing, thereby making it undesirable. On the other hand, if it exceeds 0.100%, too much time is required for carrying out the decarburizing annealing process, thereby making it also undesirable.

If Si is added in an amount less than 2.50%, a low iron loss property cannot be obtained, while, if it exceeds 4.00%, the cold rollability is degraded.

Mn and S are the elements which are needed for forming precipitations, and, of them, if Mn is added in an amount departing from the range of 0.030–0.150%, a proper distribution of MnS for inhibiting the grain growth cannot be achieved. Meanwhile, if the addition of S exceeds 0.050%, the de-sulphurizing cannot be carried out sufficiently during the final high temperature annealing degration in the magnetic properties, while if it is added in an amount less than 0.010%, a sufficient amount of precipitation in the form of a sulfide cannot be obtained, thereby making it undesirable.

The soluble Al and N are the elements which are needed for forming precipitates, and, of them, if the soluble Al is added in an amount less than 0.010%, the orientation of the secondary recrystallization is deteriorated causing the magnetic flux density to be lowered, while, if it exceeds 0.050%, the development of the secondary recrystallization becomes unstable, thereby making it undesirable. Therefore a more desirable range of the addition of the soluble Al is 0.020–0.030%. Meanwhile, if N is added in an amount less than 0.0030%, the amount of AlN becomes insufficient, while, if it exceeds 0.0120%, a defect in the form of blisters is produced in the final products.

As for Cu and P which are the characteristic feature of the present invention, their most effective addition ranges are 0.030–0.300% for Cu, and 0.020–0.200% for P. If the stability of the development of the secondary recrystallization and the improvement of the orientation of the secondary recrystallization are considered, their most effective addition ranges are 0.050–0.150% for Cu and 0.040–0.120% for P. Cu is the element which is needed for forming $Cu_2S$, and, if it is added in an amount less than 0.030%, a sufficient amount of precipitates in the form of $Cu_2S$ cannot be obtained, so that, if it is manufactured in a thickness thinner than the normal one, the secondary recrystallization cannot be formed in a stable manner. Meanwhile, if it exceeds 0.300%, although the secondary recrystallization can be formed, its orientation is aggravated. Meanwhile, P is a grain boundary. segregating element which improves the grain growth inhibiting force, and, if this element is added in an amount less than 0.020%, superior magnetic properties cannot be obtained, while, if it exceeds 0.200%, the cold rollability is deteriorated.

Within the above addition ranges of Cu and P, the addition ratio of them (Cu/P) should be most desirably 0.50–3.00, because, if the value of Cu/P is less than 0.50, the formation rate of the secondary recrystallization grains are lowered to some degree, while, if the value of Cu/P exceeds 3.00, the magnetic flux density, i.e., the orientation of the secondary recrystallization, tends to be aggravated.

By applying a melting process, and an ingot making process (or continuous casting process) in the normal manner, the silicon steel which is manufactured in the above described manner is made suitable for carrying out the succeeding processes which are usually performed for the normal high magnetic flux density oriented electrical steel sheet.

The silicon steel having the chemical composition as described above is used as a material for manufacturing a high magnetic flux density oriented electrical steel sheet, and the process for manufacturing such a steel sheet will be described below.

The silicon steel slab of the present invention is rolled to a certain thickness by applying the normal hot rolling process. The hot rolled plate undergoes a precipitation annealing at a temperature of 950–1200° C. for 30 seconds–30 minutes in order to adjust the precipitating state of AlN, and then, is subjected to a quenching process. This plate which has undergone the precipitation annealing process is subjected to a pickling process, and then is subjected to one round of cold rolling, or is subjected to two or more rounds of cold rolling processes including an intermediate annealing process.

The final cold rolling reduction ratio (the relevant reduction ratio is used for the case of performing only one round of cold rolling) may be as high as 65–95%, or more desirably as high as 80–92%. The reduction ratios for other than the last rolling process are not important, and therefore, they will not be defined here. Between the plural passes of the cold rolling processes, aging processes are performed at a temperature of 100–300° C. for 30 seconds–30 minutes in order to improve the magnetic properties.

In carrying out the cold rolling, the sheet may be cold-rolled to a final thickness of 0.27–0.35 mm, the magnetic properties being superior in this case. However, more desirably, the sheet can be cold-rolled to a thickness range of 0.15–0.27 in order to further reduce the iron loss. The reason for the desirableness of the above range is that, if the final thickness is less than 0.15 mm, the secondary recrystallization does not develop in a stable manner. On the other hand, if it is over 0.27 mm, the reduction of the iron loss due to the reduction of the thickness becomes meager, although the secondary recrystalization occurs in a stable manner.

The steel sheet which is cold rolled in the above described manner is decarburized and primarily recrystallized by being subjected to a decarburizing annealing process. In the present invention, the decarburizing annealing process is desirably carried out at a temperature of 800–900° C. for 30 seconds–10 minutes under an atmosphere of humid hydrogen or a mixed atmosphere of humid hydrogen and nitrogen. After carrying out the decarburizing annealing process, an annealing separator is coated on the surfaces of sheets in order to prevent surface to surface adherence and to promote the formation of glass films.

As the annealing separator, MgO, $TiO_2$ and $Na_2B_4O_7$ may be used as the major ingredients. Then this sheet is subjected to a high temperature annealing process at a temperature of 1200° C. for over 5 hours for the secondary recrystallization and for a purification, and, as the atmosphere for this process, dry pure hydrogen or a mixture of hydrogen and nitrogen may be used. After carrying out this annealing, an inorganic glass film is formed on the surface of the steel sheet, but it is desirable to perform a coating in order to give a tension for the purpose of improving the iron loss through the reduction of the size of the magnetic domains.

The grain oriented electrical steel sheet manufactured in the above described manner has the following chemical composition: 2.50–4.00% of Si; 0.030–0.150% of Mn; 0.030–0.300% of Cu; and 0.020–0.200% of P, the balance being Fe. Here, Si is an element which increases the inherent resistivity of the steel sheet to provide a low iron loss, while Mn, Cu and P are needed to promote the development of the secondary recrystallization grains having a nice orientation. The other elements such as C, S, N and Al are indispensable in developing the secondary recrystallization, but these elements are almost removed during the decarburizing annealing process and the final high temperature annealing process, and they remain only in negligible amounts in the final products. Meanwhile, the other elements such as Si, Mn, Cu and P remain in the steel sheet intact even after undergoing the decarburizing annealing process and the final high temperature annealing process, but they do not deteriorate magnetic properties. Therefore, the reason for limiting the amounts of the elements such as Si, Mn, Cu and P is same as the reason for limiting their amounts during the manufacturing process.

Now the present invention will be described based on actual examples.

Example 1

As shown in Table 1 below, a silicon steel slab (thickness: 40 mm) containing C, Si, Mn, S, soluble Al and N was prepared, and another silicon steel slab (thickness: 40 mm) containing Cu and P in addition to the above elements was prepared. These silicon steel slabs were heated to a temperature of 1350° C., and then, were hot-rolled to a thickness of 2.3 mm. Then they were annealed at a temperature of 1200° C. for 4 minutes, then were slowly cooled down to a temperature of 1200° C., and then, were quenched in a boiling water of 100° C.

Thereafter, a pickling process was carried out, and then, cold rolling processes were carried out to obtain a final thickness of 0.20 mm.

Between the passes of the cold rolling processes, aging treatments were carried out at a temperature of 200° C. for 5 minutes, and decarburizing annealing processes were carried out at a temperature of 840° C. under an atmosphere of a gas mixture of hydrogen (75%) and nitrogen (25%) for 3 minutes.

Then an annealing separator containing ingredients of MgO, $TiO_2$ and $Na_2B_4O_7$ was coated on the sheets. Then a final high temperature annealing process was carried out at a temperature of 1200° C. for 20 hours, and then, a tension coating fluid containing major ingredients of aluminum phosphate, anhydrous chromate and colloidal silica was coated. Then an annealing process was performed at a temperature of 840° C. for one minute for flattening the steel sheets, and then, the secondary recrystallization development rate and the magnetic properties were measured, the measured results being as shown in Table 1 below. Meanwhile, the Chemical compositions of the respective steels are shown in Table 2 below.

TABLE 1

| Steel sheets | chemical composition (weight %) C | Si | Mn | S | Al* | N | Cu | P | secondary recrystallization rate (%) | Magnetic properties B10 | W17/50 |
|---|---|---|---|---|---|---|---|---|---|---|---|
| Com A | 0.083 | 3.14 | 0.077 | 0.027 | 0.027 | 0.0080 | — | — | 70 | 1.72 | 1.39 |
| Com B | 0.082 | 3.14 | 0.079 | 0.028 | 0.028 | 0.0070 | 0.010 | — | 95 | 1.80 | 1.30 |
| Com C | 0.083 | 3.15 | 0.076 | 0.026 | 0.028 | 0.0078 | — | 0.080 | 80 | 1.83 | 1.26 |
| Invt | 0.082 | 3.15 | 0.077 | 0.027 | 0.026 | 0.0079 | 0.090 | 0.060 | 100 | 1.93 | 1.09 |
| Com D | 0.032 | 3.14 | 0.078 | 0.028 | 0.028 | 0.0079 | 0.520 | 0.075 | 100 | 1.87 | 1.10 |
| Com E | 0.083 | 3.14 | 0.076 | 0.027 | 0.027 | 0.0078 | 0.070 | 0.230 | | Destroyed*** | |

TABLE 2

| Steel sheets | Chemical composition (weight %) Si | Mn | Cu | P | Other elements |
|---|---|---|---|---|---|
| Com A | 3.14 | 0.077 | — | — | Fe and tiny amounts of Al, C, N, S |
| Com B | 3.14 | 0.077 | 0.098 | — | Same |
| Com C | 3.15 | 0.076 | — | 0.079 | same |
| Invt | 3.15 | 0.076 | 0.090 | 0.059 | Same |
| Com D | 3.14 | 0.077 | 0.316 | 0.075 | Same |

In the above tables, "Com" indicates comparative steel sheets, and "Invt" indicates the steel sheets of the present invention, while other symbols are as follows.

*: amount of soluble aluminum.

**: The unit of magnetic flux density ($B_{10}$) is Tesla, and the unit of iron loss ($W_{17/50}$) is W/kg.

***: During the cold rolling process, the steel sheets were severely damaged, and therefore, the subsequent processes could not be performed.

In the above table, the secondary recrystallization rate (%) was measured in such a manner that the steel sheet was etched with a boiling chloric acid after carrying out the final high temperature annealing process, and then the macro structure was observed, thereby deciding the area ratio occupied by the secondary recrystallized grains. In other actual examples to be described below, the measurements are carried out in the same manner.

As shown in Table 1 above, when a cold rolling was carried out to a thickness of 0.20 mm, the comparative sheet A containing only MnS and AlN showed unstable developments of secondary recrystallization grains, thereby deteriorating the magnetic properties. When only Cu was added (as in the case of the comparative steel sheet B), although the secondary recrystallization was developed in an acceptable manner, the magnetic flux density was drastically lowered, thereby making it impossible to obtain superior magnetic properties. Further, among the steel sheets containing precipitates such as MnS and AlN, if only P was added (as in the case of the comparative steel sheet C), the secondary recrystallization development rate was very low, thereby making the sheet unsuitable for cold-rolling to a thin thickness.

On the other hand, in the case of the steel sheet of the present invention in which proper amounts of Cu and P were mixedly added, the secondary recrystallization was developed in a perfect manner even under a thin thickness, as well as giving superior orientation by making it possible to induce a high magnetic flux density. However, even if Cu and P were mixedly added, if the amount of Cu exceeded 0.300% (as in the case of the comparative steel sheet D), an acceptable magnetic flux density could not be obtained, although the secondary recrystallization was developed in a perfect manner. Meanwhile, if the amount of P exceeded 0.200% (as in the case of the comparative steel sheet E), the steel sheet was severely damaged during the cold rolling process, thereby making it impossible to measure magnetic properties.

Meanwhile, among the elements which are contained in the silicon steel sheet (as shown in Table 1), Al, C, N and S were almost removed during the annealing processes, leaving only tiny amounts of them. However, the other elements such as Si, Mn, Cu and P remained intact in the final products, as shown in Table 2 above.

Example 2

A silicon steel slab was prepared, the slab containing 0.073% of C, 3.13% of Si, 0.075% of Mn, 0.027% of S, 0.026% of soluble Al, and 0.0073% of N, and another same silicon steel slab was prepared in which 0.080% of Cu and 0.080% of P were added in the melting stage. These slabs were subjected to hot rolling processes in the normal manner to reduce them to a thickness of 2.3 mm. Then they were annealed at a temperature of 1130° C. for 1 minute, were slowly cooled down to 930° C., and then, were quenched in a boiling water of 100° C. Then acid washes were carried out, and then, cold rolling processes were carried out, thereby obtaining cold rolled steel sheets having thicknesses of 0.35, 0.30, 0.27, 0.23, 0.20, 0.18, 0.15 and 0.12 mm. Between the passes of the cold rolling process, aging treatments were carried out at a temperature of 180° C. for 5 minutes. Then a decarburizing annealing process was carried out at a temperature of 830° C. for 5 minutes under an atmosphere of a gas mixture of nitrogen (75%) and hydrogen (25%) having a dew point of 55° C. Then an annealing separator containing major ingredients of MgO, $TiO_2$ and $Na_2B_4O_7$ was coated. Then a final high temperature annealing was carried out at a temperature of 1200° C. for 20 hours. Thereafter, a tension coating fluid containing major ingredients of aluminum phosphate, anhydrous chromic acid, and colloidal silica was coated, and then, a flattening annealing process was carried out at a temperature of 850° C. for one minute. Then measurements were carried out on the variations of the magnetic properties and the secondary recrystallization rates as against the variations of the final sheet thickness, and the measured results are shown in Table 3 below.

TABLE 3

| Cold rolled thickness (mm) | Secondary recstllzn (%) | Magnetic prpts $B_{10}$ (Tesla) | $W_{17/50}$ (W/kg) | Additions | Remarks |
|---|---|---|---|---|---|
| 0.35 | 100 | 1.94 | 1.19 | MnS, AlN, P | Invt 1 |
| " | 100 | 1.93 | 1.21 | MnS, AlN | Com a |

TABLE 3-continued

| Cold rolled thickness (mm) | Secondary recstllzn (%) | Magnetic prpts $B_{10}$ (Tesla) | $W_{17/50}$ (W/kg) | Additions | Remarks |
|---|---|---|---|---|---|
| 0.30 | 100 | 1.94 | 1.21 | MnS, AlN, Cu, P | Invt 2 |
| " | 100 | 1.92 | 1.17 | MnS, AlN | Com b |
| 0.27 | 100 | 1.94 | 1.07 | MnS, AlN, Cu, P | Invt 3 |
| " | 94 | 1.88 | 1.24 | MnS, AlN | Com c |
| 0.23 | 100 | 1.93 | 1.04 | MnS, AlN, Cu, P | Invt 4 |
| " | 85 | 1.81 | 1.35 | MnS, AlN | Com d |
| 0.20 | 100 | 1.94 | 1.01 | MnS, AlN, Cu, P | Invt 5 |
| 0.18 | 98 | 1.9 | 0.99 | MnS, AlN Cu, P | Invt 6 |
| 0.15 | 95 | 1.91 | 0.98 | MnS, AlN Cu, P | Invt 7 |
| 0.12 | 80 | 1.78 | 1.34 | MnS, AlN Cu, P | Com e |

In the above table, "Com" indicates the comparative steel sheets, and "Invt" indicates the steel sheets of the present invention.

As shown in Table 3 above, the steel sheets (1–7) of the present invention, in which proper amounts of Cu and P are added in addition to MnS and AlN, show superior magnetic properties over the comparative steel sheets (a–d) containing only MnS and AlN, for the same cold rolled thickness. Further, even with the thin thicknesses of 0.15–0.27 mm, the steel sheets (3–7) of the present invention show stable development of secondary recrystallizations, and also show high magnetic flux densities and low iron losses. Meanwhile, the comparative steel sheet (e) which has a thickness of 0.12 mm shows a low magnetic flux density and a high iron loss, although it comes within the same composition range as that of the present invention.

Example 3

To silicon steel slabs containing 0.073% of C, 3.12% of Si, 0.070% of Mn, 0.025% of S, 0.024% of soluble Al, 0.0071% of N and 0.11% of Cu, the element P was added in three different amounts within the addition range of the present invention, i.e., in the amounts of (A) 0.020%, (B) 0.070% and (C) 0.200%.

These slabs were subjected to hot rolling processes to reduce them to a thickness of 2.3 mm, and then subjected to a first cold rolling process to reduce them to a thickness of 1.57 mm, after carrying out a pickling process. Then they were annealed at a temperature of 1100° C. for 3 minutes, slowly cooled down to a temperature of 950° C., and then, were quenched in a boiling water of 100° C. Then a pickling process was performed again, and then, a second cold rolling was performed to reduce them to a thickness of 0.23 mm. Between the passes of the cold rolling process, aging processes were carried out at a temperature of about 150° C. for 10 minutes. Then a decarburizing annealing was carried out at a temperature of 850° C. for 90 seconds under an atmosphere consisting of a gas mixture of nitrogen (25%) and hydrogen (75%) having a dew point of 65° C. Then an annealing separator having ingredients of MgO, $TiO_2$ and $Na_2B_4O_7$ was coated, and thereafter, a final high temperature annealing was carried out at a temperature of 1180° C. for 20 hours. Then a tension coating fluid containing major ingredients of aluminum phosphate, anhydrous chromic acid and colloidal silica was coated, and then, a flattening annealing was carried out at a temperature of 800° C. for 1.5 minutes. After completing the whole process, the secondary recrystallization development rate (%) and the magnetic properties were measured, the measured results being as shown in Table 4 below.

TABLE 4

| Steel sheets | secondary recstllzn rate (%) | Magnetic properties $B_{10}$ (Telsa) | $W_{17/50}$ (W/Kg) |
|---|---|---|---|
| A | 98 | 1.92 | 1.06 |
| B | 100 | 1.95 | 1.03 |
| C | 95 | 1.93 | 1.05 |

As shown in Table 4 above, if P is added in an amount within the addition range of the present invention, the secondary recrystallization occurred in a stable manner and the magnetic properties were also superior, when the cold rolled thickness was 0.23 mm. However, with the value of Cu/P being adjusted to 1.57 as in the case of the steel sheet B, the magnetic properties were further improved.

Example 4

To silicon steel slabs containing 0.079% of C, 3.15% of Si, 0.073% of Mn, 0.029% of S, 0.028% of soluble Al, 0.0082% of N and 0.055% of P, the element Cu was added in three different amounts within the addition range of the present invention, i.e., in the amounts of (D) 0.030%, (E) 0.080% and (F) 0.300%. These slabs were hot-rolled to a thickness of 2.0 mm in the normal manner, and then, were annealed at a temperature of 1120° C. for two minutes. Then they were slowly cooled down to a temperature of 950° C., and were quenched in a boiling water of 100° C. Then a pickling process was carried out, and then, a cold rolling was carried out to reduce them to a final thickness of 0.18 mm. Between the passes of the cold rolling process, aging treatments were carried out at a temperature of 200° C. for 5 minutes. Then a decarburizing annealing was carried out at a temperature of 850° C. for 90 seconds under an atmosphere consisting of a gas mixture of nitrogen (25%) and hydrogen (75%) having a dew point of 68° C. Then an annealing separator containing a mixture of MgO, $TiO_2$ and $Na_2B_4O_7$ was coated, and then, a final high temperature annealing was carried out at a temperature of 1180° C. 20 hours. Then a tension coating fluid containing major ingredients of aluminum phosphate, anhydrous chromic acid and colloidal silica was coated, and then, a flattening annealing was carried out at a temperature of 850° C. for 50 seconds. After completing the whole process, the secondary recrystallization rate and the magnetic properties were measured, the measured results being as shown in Table 5 blow.

TABLE 5

| Steel sheets | secondary recstllzn rate (%) | Magnetic properties $B_{10}$ (Telsa) | $W_{17/50}$ (W/Kg) |
|---|---|---|---|
| D | 95 | 1.93 | 1.03 |
| E | 100 | 1.94 | 1.01 |
| F | 93 | 1.90 | 1.05 |

As is apparent in Table 5 above, if the amount of Cu is varied within the addition range of the present invention, the secondary recrystallization occurred in a stable manner, and superior magnetic properties were also obtained, even with a cold rolled thickness of 0.18 mm. The steel sheet E in which the value of Cu/P is 1.46 shows the most advantageous iron loss characteristics.

Example 5

Cu and P were mixedly added at a melting stage into silicon steels containing 0.077% of C, 3.17% of Si, 0.076% of Mn, 0.028% of S, 0.025% of soluble Al and 0.0075% of N, the balance being Fe. The addition ratio (Cu/P) was varied within the range of 0.25–6.50 when preparing the silicon steel slabs having a thickness of 40 mm. The subsequent steps of the process were the same as that of Example 1, except that the final thickness of the steel sheet was 0.23 mm. After completing the whole process, the rate and orientation of the secondary recrystallization were measured, the measured results being as shown in FIG. 1.

Referring to FIG. 1, the orientation of the secondary recrystallization is expressed in the value of magnetic flux density $B_{10}$. As can be seen in FIG. 1, when an electrical steel sheet is manufactured to a thickness of 0.23 mm by mixedly adding Cu and P, if the value of Cu/P comes within the range of 0.50–3.00, then it is seen that the secondary recrystallization rate and the magnetic properties $B_{10}$ are superior. However, if the value of Cu/P is less than 0.50, the secondary recrystallization rate is lowered, while if it is over 3.0, the magnetic flux density $B_{10}$, i.e., the orientation of the secondary recrystallization is deteriorated.

According to the present invention as described above, Cu and P are mixedly added at a melting stage of a silicon steel containing MnS and AlN as the grain growth inhibitors, and the silicon steels are finally cold-rolled to a thickness of 0.15–0.27 mm, thereby producing a high magnetic flux density and low iron loss oriented electrical steel sheets which are applicable even to thin gauge products.

What is claimed is:

1. A grain oriented electrical steel sheet having superior magnetic properties on the order of greater than about 1.9 Tesla magnetic flux density ($B_{10}$) and less than about 1.1 W/Kg iron or core loss ($W_{17/50}$), said steel sheet in a decarburized condition, having a thickness within the range of about 0.15–0.27 mm, and consisting essentially of:

2.50–4.00% of Si, 0.030–0.150% of Mn, 0.030–0.300% of Cu and 0.020–0.200% of P all in weight %, the balance being Fe and negligible amounts of C, S, N and Al.

2. The grain oriented electrical steel sheet having superior magnetic properties as claimed in claim 1, wherein the amounts of Cu and P are 0.050–0.150% and 0.040–0.120% respectively all in weight %.

3. The grain oriented electrical steel sheet having superior magnetic properties as claimed in claim 1, wherein the value of Cu/P comes within the range of 0.50–3.0.

4. A process for producing a grain oriented electrical steel sheet having superior magnetic properties on the order of greater than about 1.9 Tesla magnetic flux density. ($B_{10}$) and less than about 1.1 W/Kg iron or core loss ($W_{17/50}$), comprising the steps of:

preparing a silicon steel slab by adding 0.030–0.300% of Cu and 0.020–0.200% of P to a molten silicon steel, said silicon steel consisting essentially of 0.030–0.100% of C, 2.50–4.00% of Si, 0.030–0.150% of Mn, 0.010–0.050% of S, 0.010–0.050% of soluble Al and 0.003–0.012% of N, the balance being Fe, all in weight %; and carrying out, on said silicon steel slab, a hot rolling, a precipitation annealing, a pickling process, a cold rolling to a thickness of about 0.15–0.27 mm, a decarburizing annealing, coating with an annealing separator, and a high temperature annealing.

* * * * *

UNITED STATES PATENT AND TRADEMARK OFFICE

CERTIFICATE OF CORRECTION

PATENT NO. : 5,401,332

DATED : March 28, 1995

INVENTOR(S) : Chung S. Lee and Jong S. Woo

It is certified that error appears in the above-indentified patent and that said Letters Patent is hereby corrected as shown below:

Title page, after [75] Inventors:, "Wo" should read --Woo--.

Column 1 Lines 51-52 "producted" should read --produced--.

Column 2 Line 28 "the their" should read --their--.

Column 3 Line 62 "balance,." should read --balance,--.

Column 3 Line 68 "0.0300" should read --0.030--.

Column 4 Line 31 "degration" should read --causing degradation--.

Column 4 Line 64 "boundary." should read --boundary--.

Column 6 Line 30 after "is" insert --the--.

UNITED STATES PATENT AND TRADEMARK OFFICE

CERTIFICATE OF CORRECTION

PATENT NO. : 5,401,332

DATED : March 28, 1995

INVENTOR(S) : Chung S. Lee and Jong S. Woo

It is certified that error appears in the above-indentified patent and that said Letters Patent is hereby corrected as shown below:

Table 1, Column 7, under the heading chemical composition (weight %), subheading Mn, in row Com B, "0.079" should read --0.078--.

Column 10 Line 47 after "1180° C." insert --for--.

Column 10 Line 55 "blow" should read --below--.

Claim 4 Line 24 Column 12 "density." should read --density--.

Signed and Sealed this

First Day of August, 1995

Bruce Lehman

*Attest:*

BRUCE LEHMAN

*Attesting Officer*

*Commissioner of Patents and Trademarks*